US005296896A

United States Patent [19]

Nishiyama et al.

[11] Patent Number: 5,296,896

[45] Date of Patent: Mar. 22, 1994

[54] IMAGE FORMING APPARATUS WITH STORAGE FOR COPYING CONDITIONS

[75] Inventors: Hidetomo Nishiyama, Yamatokoriyama; Atsushi Kurimoto, Nara; Kazunori Iwasa, Yamatokoriyama; Masami Oka, Osaka, all of Japan

[73] Assignee: Sharp Kabushiki Kaisha, Osaka, Japan

[21] Appl. No.: 847,265

[22] Filed: Mar. 10, 1992

[30] Foreign Application Priority Data

Mar. 11, 1991 [JP] Japan ..... 3-043902

[51] Int. Cl.[5] ..... G03G 21/00

[52] U.S. Cl. ..... 355/208; 355/203; 355/204

[58] Field of Search ..... 355/203, 204, 208, 210, 355/245, 200, 219, 202, 229, 221, 326; 346/160; 358/300

[56] References Cited

U.S. PATENT DOCUMENTS

| | | | |
|---|---|---|---|
| 4,348,099 | 9/1982 | Fantozzi | 355/208 |
| 4,716,438 | 12/1987 | Farrell | 355/201 |
| 4,757,348 | 7/1988 | Rourke et al. | 355/200 X |
| 4,851,878 | 7/1989 | Sumida | 355/204 |
| 4,876,571 | 10/1989 | Nakamura et al. | 355/210 |
| 4,879,577 | 11/1989 | Mabrouk et al. | 355/208 |
| 4,935,787 | 6/1990 | Maeda et al. | 355/326 |
| 4,987,447 | 1/1991 | Ojha | 355/204 |
| 5,060,013 | 10/1991 | Spence | 355/203 X |
| 5,083,159 | 1/1992 | Corona et al. | 355/208 |

FOREIGN PATENT DOCUMENTS

| | | |
|---|---|---|
| 63-139467 | 6/1988 | Japan . |
| 63-197965 | 8/1988 | Japan . |
| 64-578 | 1/1989 | Japan . |
| 02157866 | 6/1990 | Japan . |

*Primary Examiner*—A. T. Grimley
*Assistant Examiner*—Shuk Y. Lee

[57] ABSTRACT

An image forming apparatus including a condition determining device for determining optimum conditions automatically for copying a document during copying, a blank lamp for recording information concerning the determined conditions in code on a sheet of copy paper, a code scanner for reading the coded information when producing a copy from the copy paper carrying the code thereon, and control circuits for setting copying conditions according to the read information. With this configuration, when producing copies of the image on the original document, by reading the coded information and setting the copying conditions, an image satisfying the optimum conditions is readily obtained whenever it is desired. Moreover, even when making copies from a copied image which was produced through subsequent copying, the formed images always have the same quality that the original has.

8 Claims, 5 Drawing Sheets

IMAGE FORMING APPARATUS WITH STORAGE FOR COPYING CONDITIONS

FIELD OF THE INVENTION

The present invention relates to storage of information including copying conditions necessary for the formation of an image, with regard to image forming apparatuses, such as copying machines.

BACKGROUND OF THE INVENTION

When a document is copied with the use of a conventional image forming apparatus, for example, a color copying machine, a formed image slightly differs from the original image in quality due to the machine's features. When another copy is made from a photocopy of the original document, the difference becomes more significant. Therefore, when the image on the original document and the image formed by the latest copying operation after subsequent copying are compared, there are differences between the two images in color quality and balance if they are color copies or in the thickness of letters and lines if they are black-and-white copies. The differences become greater as the number of times performing subsequent copying increases. To overcome such a problem, for example, a color copy is produced from an original color document by adjusting the color-balance in accordance with the tone of the original document. If there is a need to keep conditions for producing copies of a good color-balance with respect to a document, the conditions are stored in a memory in the main body of the color copying machine. So, when copying the document again, the copying conditions are read from the memory and set by depressing the memory key on the operation panel so as to make copies in accordance with the conditions.

With the apparatus, however, such conditions must be stored in the memory by the user, thereby causing the user to undertake time-consuming tasks.

Moreover, the user must remember which document corresponds to which copying conditions stored. This not only causes the user trouble, but may also produce copies depending on erroneous conditions due to the user's incorrect memory or changes in the content of memory made by someone else.

SUMMARY OF THE INVENTION

An object of the present invention is to provide an image forming apparatus capable of recording information including optimum conditions for copying a document, on a copy paper sheet on which an image is to be formed during copying of the document.

Another object of the present invention is to provide an image forming apparatus, when copying the same document again, which is capable of forming its image readily depending on optimum conditions for the document by simply reading the information concerning the optimum conditions.

Still another object of the present invention is to provide an image forming apparatus capable of forming an image which is a near perfect copy of the original image even from a copy of the original image which was produced through subsequent copying.

In order to achieve the above objects, an image forming apparatus of the present invention for forming an image by applying light on a document and using reflected light from the document, comprises condition determining means for determining optimum conditions for forming an image, and code forming means for converting information concerning the determined conditions into a code and forming the code on a copy paper sheet on which the image is to be formed. The image forming apparatus is also provided with code reader means for reading the code when forming an image by using the copy paper carrying the code thereon as an original document, and adjusting means for setting conditions for the formation of the image according to the code read.

With this configuration, since information necessary for the formation of an image of good quality is automatically recorded in code on the copy paper, the user does not have to undertake the trouble to adjust, for example, the amounts of light, charge, and toners to be transferred, for setting conditions for the formation of the image. Moreover, when producing a copy from a copied document having a formed code thereon, the image is readily formed on the copy paper whenever it is desired depending on the optimum conditions for the document by reading the coded information and setting the optimum conditions. Therefore, the image forming apparatus's features do not deteriorate reproduction quality, enabling the formation of an image of good quality. Namely, the formed image is almost same as the original image in quality.

Further, established conditions are stored by recording them directly on the copy paper without storing them in a memory in the main body. Therefore, the conditions can never be forgotten or changed by anyone.

The image forming apparatus may further comprises test-print mode setting means for performing test-printing before forming an image, and controller means which controls the code forming means to form the image on the copy paper only when the test-print mode is selected.

With this configuration, since the coded information is recorded only on a copy paper sheet for test-printing, the entire image on the original document is copied on copy paper sheets which will make fair copies without missing out any portions.

The image forming apparatus may also be provided with switching means for switching modes between a first copy mode in which only an image is formed on the copy paper and a second copy mode in which the information necessary for the formation of an image is recorded in code on the copy paper together with the image.

According to this configuration, documents of low frequency in use, documents which cause a problem if their images are partly lost due to codes and documents of high frequency in use whose information necessary for the formation of their images is needed to be stored, are respectively copied by selecting a mode suitable for each document.

For a fuller understanding of the nature and advantages of the invention, reference should be made to the ensuing detailed description taken in conjunction with the accompanying drawings.

DETAILED DESCRIPTION OF THE PREFERRED EMBODIMENTS

The following will explain one embodiment of the present invention with reference to FIG. 1 to FIG. 4.

Figure 1:
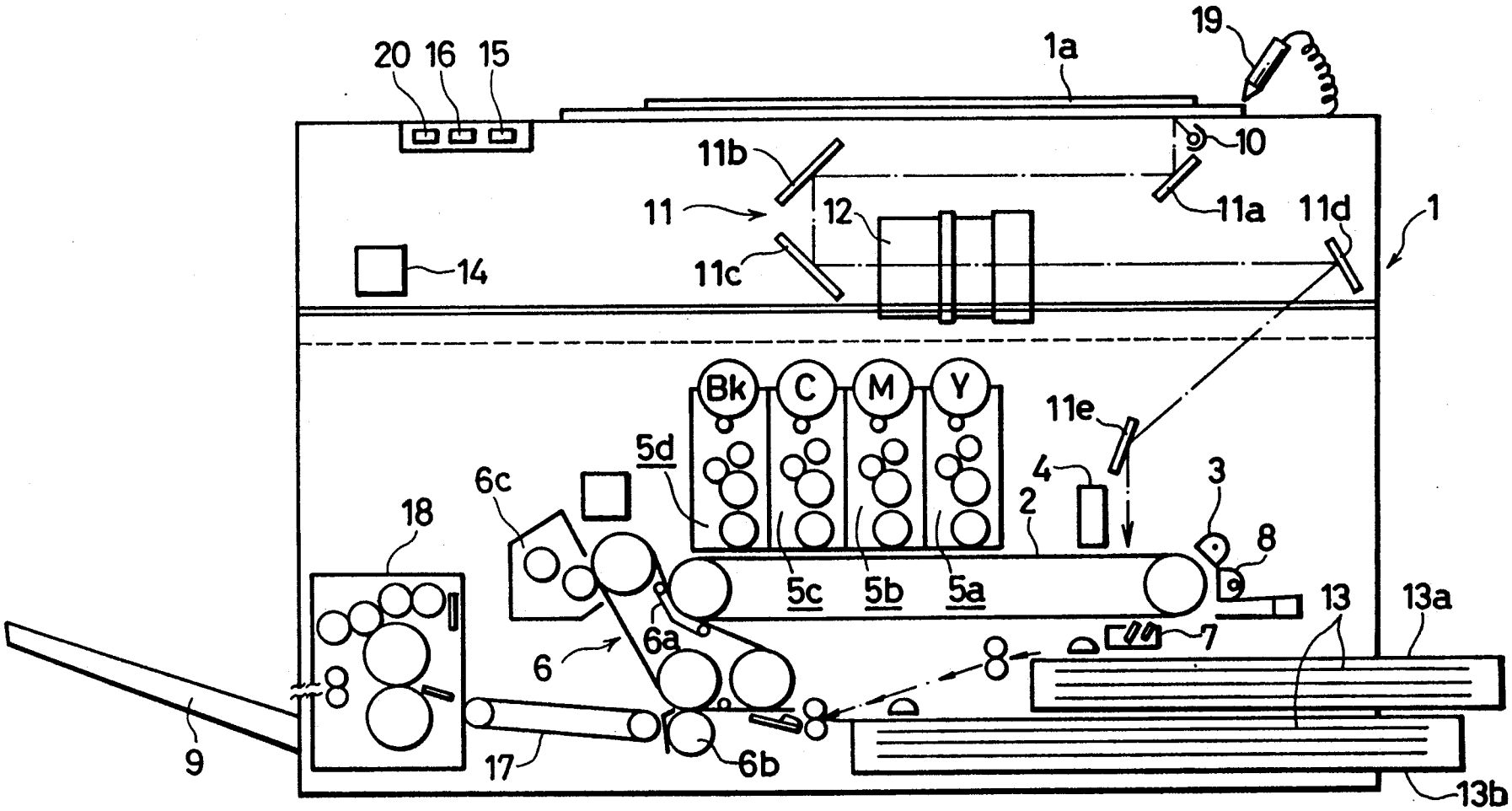
FIG. 1 is a cross section illustrating a schematic structure of a full-color copying machine of the present invention.

As illustrated in FIG. 1, a belt-like photoreceptor 2 is attached tightly around two rollers in the central location of a copying machine's main body 1. Installed around the photoreceptor 2 are a series of devices: a charger 3, a blank lamp 4, development devices 5*a*, 5*b*, 5*c* and 5*d*, a transfer body 6, a cleaning device 7, and an erase lamp 8.

The charger 3 causes a surface of the photoreceptor 2 to be charged evenly through corona discharge. The electric potential of the photoreceptor 2 is adjusted by changing the impressed voltage through a charge control circuit 23 shown in FIG. 4.

The blank lamp 4 is composed of lamps, such as light-emitting diodes (LEDs) aligned along the cross direction (in FIG. 1, a direction vertical to the face of the drawing paper) of the photoreceptor 2. When the surface of the photoreceptor 2 charged evenly by the charger 3 is partly illuminated by the blank lamp 4, the charge on the surface of the photoreceptor 2 is partly removed. At this time, the blank lamp 4 also functions as bar-code forming means for forming a bar-code on a copy paper sheet. The blank lamp 4 is connected to a blank-lamp control circuit 22 shown in FIG. 4.

The development devices 5*a* to 5*d* contain yellow, magenta, cyan and black toners, respectively. The cleaning device 7 is provided to remove any toner particles remaining on the photoreceptor 2. Meanwhile, the erase lamp 8 removes any charge remaining on the photoreceptor 2. The development devices 5*a* to 5*d* are respectively connected to a development bias control circuit 25 shown in FIG. 4.

The transfer body 6 is a dielectric sheet which is attached tightly around three rollers and in contact with the photoreceptor 2. A first transfer roller 6*a* is disposed at the contacting section of the transfer body 6 so as to transfer a toner image on the photoreceptor 2 to the transfer body 6.

A second transfer roller 6*b* and a cleaning device 6*c* are placed around the transfer body 6. The second transfer roller 6*b* transfers a color toner image on the transfer body 6 to a copy paper sheet 13 supplied timely from one of paper cassettes 13*a* and 13*b*. The second transfer roller 6*b* is connected to a transfer control circuit 24 shown in FIG. 4. The copy paper sheet 13 carrying the color image thereon is conveyed through a paper transport path 17 to a fixing device 18 where the image is fixed, and is then discharged onto a tray 9 for discharged sheets.

Installed between a document platen 1*a* and the photoreceptor 2 is an optical system 11 composed of an exposure lamp 10, reflecting mirrors 11*a* to 11*e* and a color separation filter 12. The exposure lamp 10 is connected to a light control circuit 21.

Mounted on the main body 1 are a copy key 15 for giving instructions to start copying, a test-print key 16 (test-print mode setting means) to be described later, and a switch key 20 (switching means) for switching modes between a first copy mode in which normal copying is performed and a second copy mode in which a bar-code is formed on the copy paper.

Code reader means, for example, a bar-code scanner 19 is mounted at a suitable location in the main body 1, for example, on the upper face thereof. The bar-code scanner 19 has a bar-code reader and a transmitter for transmitting signals read by the bar-code reader. The main body 1 is also provided with a controller 14 that is adjusting means for receiving the signals from the bar-code scanner 19, establishing copying conditions depending on the signals, and performing copying in accordance with the established conditions. The controller 14 also functions as condition determining means for determining optimum conditions, for example, the amounts of light, charge and toner to be transferred for copying the original document.

Figure 2:
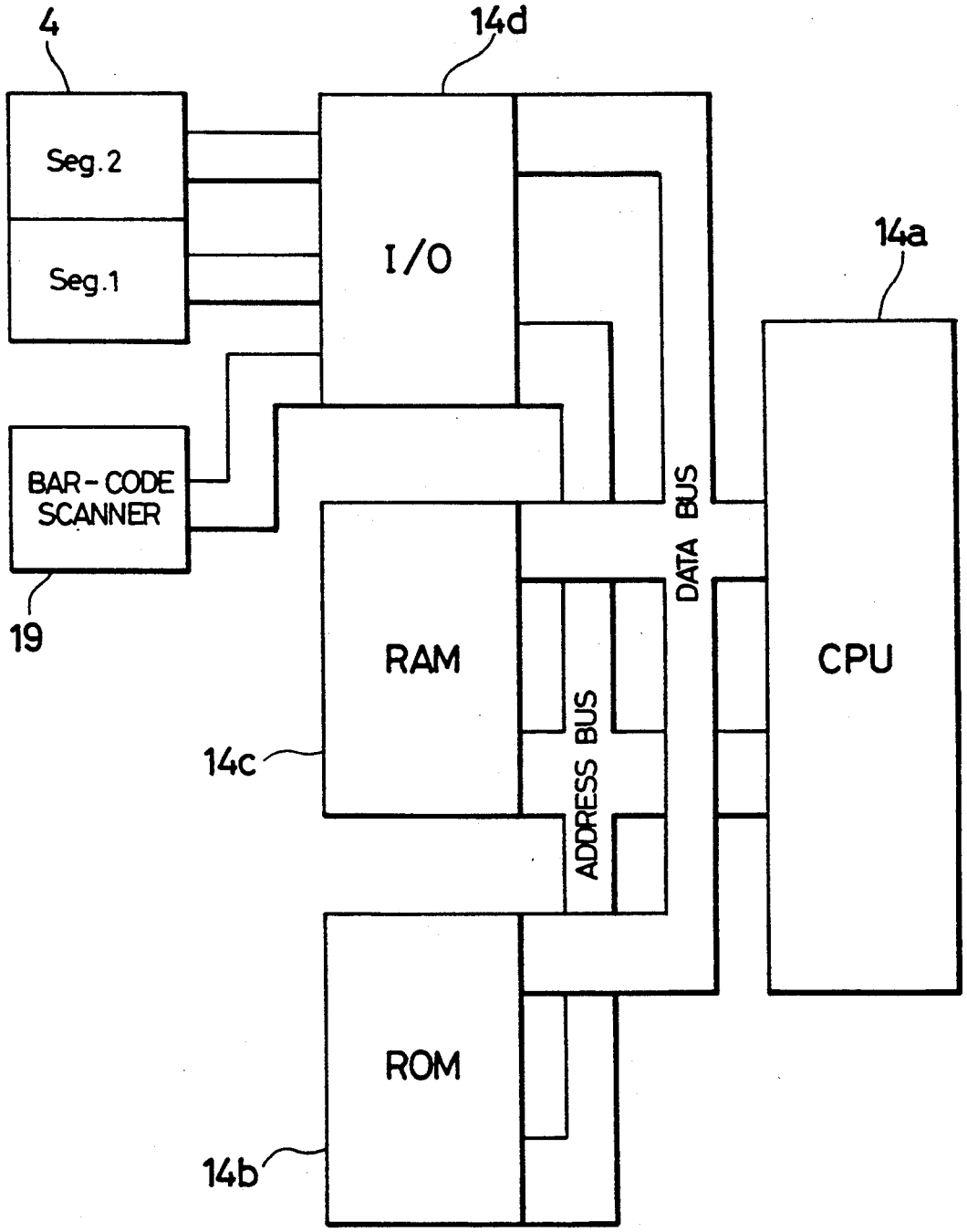
FIG. 2 is a block diagram illustrating a control state of the full-color copying machine.

As illustrated in FIG. 2, the controller 14 includes a CPU 14*a*. Connected to the CPU 14*a* are a ROM 14*b* wherein a control method is written, a RAM 14*c* for storing data for control, and an I/O port 14*d* for reading data from, for example, sensors for detecting the states of the respective sections of the copying machine. The light control circuit 21, blank-lamp control circuit 22, charge control circuit 23, transfer control circuit 24, development bias control circuit 25 and bar-code scanner 19 are respectively connected to the CPU 14*a* via the I/O port 14*d*.

For example, the blank lamp 4 is constituted by aligning 100 LED elements, and each of which is controlled individually to be switched on and off. The blank lamp 4 is provided with a lens, slit or similar device (not shown) which makes a beam of light narrower to form a bar-code on the photoreceptor 2.

The following will describe such a full-color copying machine's operations with respect to copying and the formation of a bar-code on a copy paper sheet 13.

First, a document is placed on the document platen 1*a* and the copy key 15 is depressed, so that exposure of the document for color separation is performed three times by the exposure lamp 10. Then, the reflected light from the document passes through the color separation filter 12 and forms three electrostatic latent images successively on the photoreceptor 2. Next, electric charge corresponding to unwanted portions of the electrostatic latent images is removed by the blank lamp 4. Subsequently, the electrostatic latent images are developed into visible form by the development devices 5*a* to 5*d* containing toners having the complementary colors of the colors of the color separation filter 12.

The visible toner images are conveyed to the transfer body 6 temporarily with the help of the first transfer roller 6*a*. In this manner, the toner images of yellow, magenta and cyan are respectively transferred to and superposed on the transfer body 6, whereby a complete toner image is formed.

The complete toner image is transferred to a copy paper sheet 13 supplied timely from the paper cassette 13*a* or 13*b* by the second transfer roller 6*b*. The copy paper 13 is guided through the paper transport path 17 to the fixing device 18 where the image is fixed, and is then discharged onto the tray 9 for discharged sheets.

Figure 3:
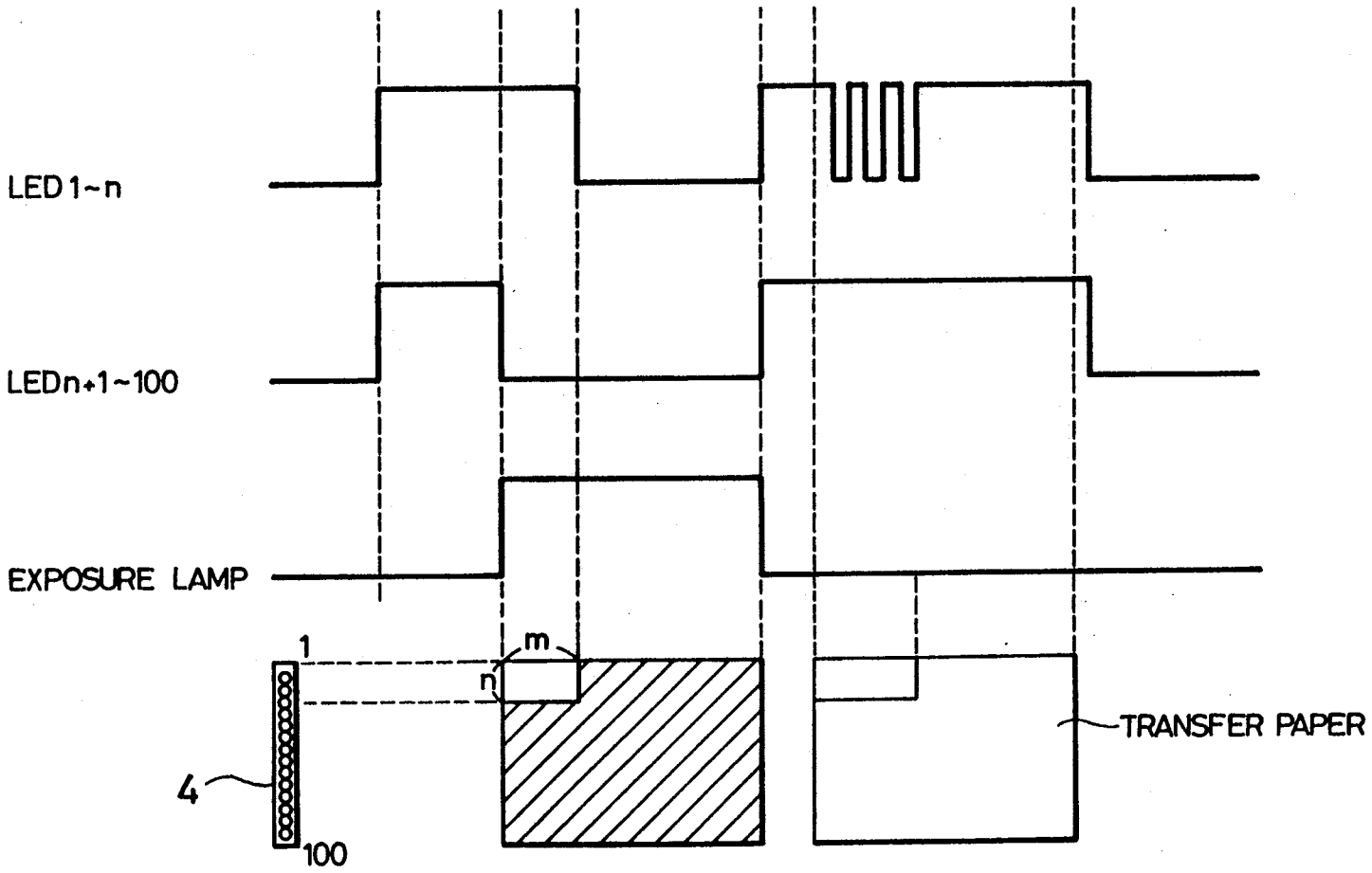
FIG. 3 is a timing chart explaining the operation of a blank lamp during the formation of a code.

FIG. 3 is a timing chart explaining the timing of the operation of the blank lamp 4 of forming a bar-code on the copy paper 13.

As illustrated in FIG. 3, during scan of each of the three colors, the blank lamp 4 is controlled such that a segment composed of n number of the LED elements, i.e. $LED_1$-$LED_n$ corresponding to an area where a bar-code is to be formed is illuminated for a period of time when the distance of m is scanned and such that $LED_{n+1}$-$LED_{100}$ are switched off. At this time, the exposure lamp 10 is illuminated during a period corresponding to the size of the original document. As a result, a toner image having an area for the formation of a bar-code is formed on the transfer body 6.

After the formation of a complete color toner image by three exposure scans, a scan is performed by activating only the blank lamp 4 so that a bar-code representing the optimum copying conditions is formed in the area for bar-code. More specifically, in order to form the bar-code in the area for bar-code, the $LED_{n+1}$-$LED_{100}$ (segment 2) of the blank lamp 4 are illuminated, while the $LED_1$-$LED_n$ (segment 1) are made flashing according to the copying conditions which have been converted into bar-code signals in advance.

Figure 4:
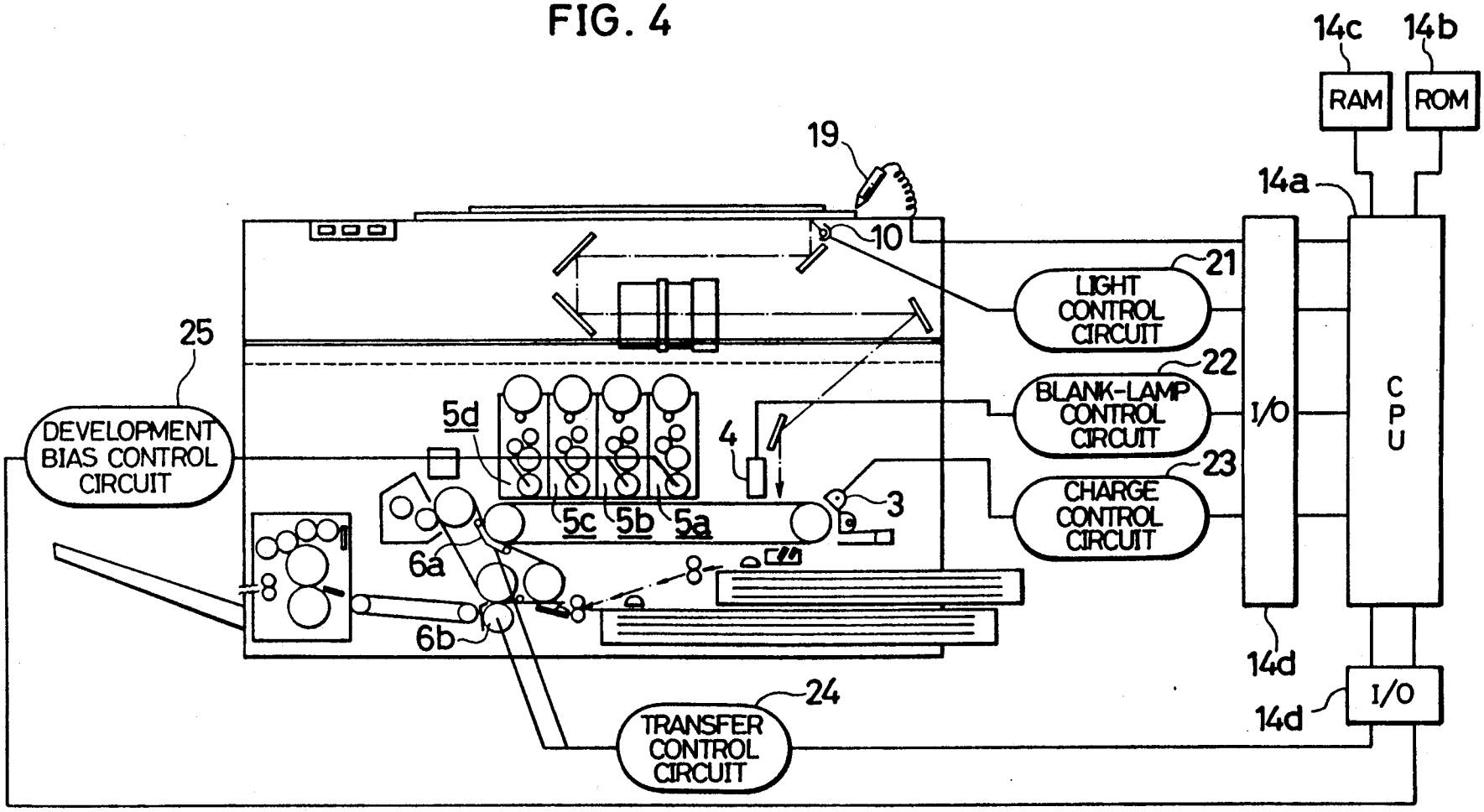
FIG. 4 is an explanatory view illustrating circuits used for adjusting the color balance in the full-color copying machine.

When the formed image is not in an optimum state, the color-balance is adjusted by light control circuit 21, charge control circuit 23, transfer control circuit 24 and development bias control circuit 25 shown in FIG. 4 so that the copied image of a desired quality is obtained. When optimum copying conditions are determined, signals representing the conditions are transmitted to a code converter (not shown) and converted into bar-code signals.

As a result, the bar-code representing the optimum copying conditions is recorded in an area on the copy paper 13, and thus copying is finished.

When the copy paper 13 carrying the bar-code together with the image thereon is used as an original document later in order to produce copies of the image based on the same optimum copying conditions, firstly, the scan key (not shown) on the operation panel is depressed so that the bar-code is read by the bar-code scanner 19 in the main body. The signals read are automatically transmitted to the controller 14 in the main body so that the copying conditions are entered to the light control circuit 21, blank-lamp control circuit 22, charge control circuit 23, transfer control circuit 24 and development bias control circuit 25 shown in FIG. 4. To avoid errors in setting conditions because of reading mistake of the scanner 19, the transmission of the bar-code signals to the main body may be controlled by providing, for example, a transmission key that allows the bar-code signals to be transmitted only when a scan is performed properly.

Subsequently, when the copy paper 13 is placed as a document on the document platen la and the copy key 15 is depressed, copying is performed according to the same optimum conditions.

In the above embodiment, the copying machine is constructed such that a bar-code is always recorded on the copy paper on which an image is to be formed. However, the copying machine may also be provided with, for example, the test-print mode in which information necessary for the formation of an image, such as copying conditions is recorded in bar-code on the copy paper and controller means which allows the bar-code to be recorded only when the test-print mode is selected. In this case, the controller 14 functions as controller means.

With this arrangement, the test-print key 16 is provided on the operation panel, and the test-print mode is selected by depressing this key. In this state, when the copy key 15 is depressed, the image and the bar-code are both recorded on the copy paper as described above.

According to this arrangement, the bar-code is recorded on the test-printed copy paper but not on sheets of the copy paper which will make fair copies. In other words, since the bar-code is not recorded on the copy paper which will make a fair copy, the entire image is formed thereon properly without missing out any portions.

In addition, the copying machine may also be provided with selecting means, for example, the controller 14 so that one of the paper cassettes 13*a* and 13*b*, which contains smaller copy paper sheets, is automatically selected and that the smaller copy paper is fed when the test-print mode is selected.

This allows the consumption of the toners to be reduced during test-printing. In addition, since the bar-code is recorded on the smaller copy paper, the copy paper having a bar-code does not take much space and therefore it is stored easily.

The operation panel may also be provided with a switch key 20 that is switching means for switching modes selectively between the copy mode (a second copy mode) in which information necessary for the formation of an image including copying conditions is recorded in bar-code on the copy paper and the normal copy mode (a first copy mode) in which a bar-code is not recorded. This enables one of the copy modes to be selected accordingly.

As a result, each of the documents, including documents of low frequency in use, documents which cause a problem if their images are partly lost due to bar-codes and documents of high frequency in use (which are copied frequently) whose information necessary for the formation of their images such as copying conditions is needed to be stored, is copied in a suitable mode.

Further, the copying machine may be constructed such that, when copying a document in the second copy mode in which information necessary for the formation of an image such as copying conditions is recorded in bar-code, a paper cassette containing copy paper sheets one size larger than the size of the document is automatically selected and the copy paper is conveyed.

Figure 5:
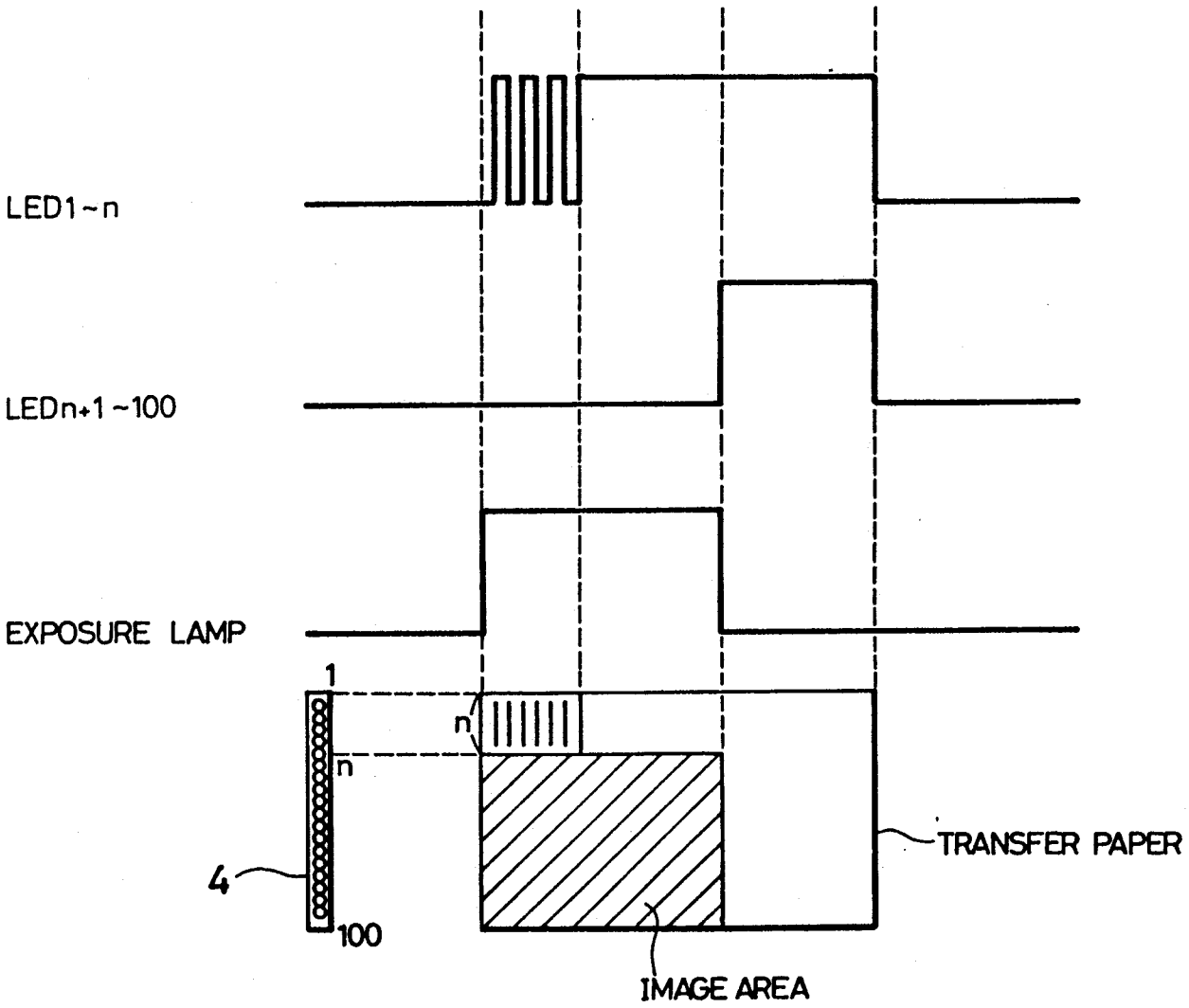
FIG. 5 is a timing chart explaining the operation of a blank lamp during the formation of a code according to another embodiment of the present invention.

With this arrangement, as illustrated in FIG. 5, the bar-code is recorded in an area other than the image area of the document, and therefore any portion of the image of the document will not be lost.

In the above-mentioned embodiments, the bar-code is recorded with the use of the blank lamp 4. However, this invention is not restricted to such an arrangement, and thus means designed exclusively for forming codes may be provided separately.

Furthermore, codes to be recorded do not necessarily need to be bar-codes, so any types of codes are used if they can be recorded on the copy paper.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An image forming apparatus for forming an electrophotographic image by applying light to an original document and using reflected light from the document, comprising:

condition determining means for determining optimum conditions of an electrophotographic process for a formation of an image;

code forming means for converting information concerning the determined optimum conditions of the electrophotographic process into a code and forming the code on a copy paper sheet;

code reader means for reading the code when forming an image by using the copy paper carrying the code and an image thereon as an original document; and adjusting means for establishing conditions of the electrophotographic process for the formation of an image according to the code read.

2. The image forming apparatus as set forth in claim 1, further comprising:

test-print mode setting means for performing test-printing before forming the image; and controller means which controls said code forming means to form the code on the copy paper only when the test-print mode is selected.

3. The image forming apparatus as set forth in claim 2, further comprising selecting means for automatically selecting a paper cassette containing smallest-sized copy paper sheets when the test-print mode is selected.

4. The image forming apparatus as set forth in claim 1, further comprising switching means for switching modes between a first copy mode in which only an image is formed on the copy paper and a second copy mode in which information concerning optimum conditions for forming an image is recorded in code on the copy paper together with the image.

5. The image forming apparatus as set forth in claim 4, further comprising selecting means for selecting a paper cassette storing copy paper sheets one size larger than a size of an original document when the second copy mode is selected.

6. The image forming apparatus as set forth in claim 1, wherein the code to be formed on the copy paper is a bar-code, and said code forming means for forming the bar-code is a blank lamp.

7. The image forming apparatus as set forth in claim 6, wherein said code reader means is a bar-code scanner.

8. The image forming apparatus as set forth in claim 1, wherein said adjusting means comprises:

a controller for controlling the image forming apparatus on the whole;

a light control circuit for controlling an amount of light to be applied to the original document;

a charge control circuit for controlling an amount of charge for a photoreceptor;

a blank-lamp control circuit for removing the charge on a surface of the photoreceptor partly;

a development bias control circuit for controlling amounts of toners to be supplied; and a transfer control circuit for controlling amounts of toners to be transferred when transferring a toner image to the copy paper, said controller being connected to said light control circuit, charge control circuit, blank lamp control circuit, development bias control circuit and transfer control circuit.

* * * * *